US005568822A

United States Patent [19]

Michelson

[11] Patent Number: 5,568,822

[45] Date of Patent: Oct. 29, 1996

[54] FILM CLEANING SYSTEM AND METHOD FOR PHOTOGRAPHIC FILM

[76] Inventor: Manfred G. Michelson, 4396 Park Vicente, Calabasas, Calif. 91302

[21] Appl. No.: 362,208

[22] Filed: Dec. 22, 1994

Related U.S. Application Data

[63] Continuation-in-part of Ser. No. 103,285, Sep. 10, 1993, abandoned.

[51] Int. Cl.[6] ..... B08B 3/10

[52] U.S. Cl. ..... 134/64 P; 134/122 P; 134/182; 134/102.3

[58] Field of Search ..... 239/103, 120, 239/533.13, 437, 452; 354/317, 319; 198/495; 162/275; 134/64 P, 64 R, 122 P, 122 R, 182, 183, 199, 102.3; 209/380; 15/306.1, 309.1; 34/69, 635, 639

[56] References Cited

U.S. PATENT DOCUMENTS

| | | | |
|---|---|---|---|
| 263,634 | 8/1882 | Webster . | |
| 577,362 | 2/1897 | Ettlinger | 239/533.13 |
| 1,793,246 | 2/1931 | Philips . | |
| 2,255,951 | 9/1941 | Tomtlund . | |
| 2,303,992 | 12/1942 | Frazer | 239/533.13 |
| 2,311,833 | 2/1943 | Holland-Letz | 239/533.13 |
| 3,163,559 | 12/1964 | Thompson et al. . | |
| 3,199,787 | 8/1965 | Oishei et al. | 239/533.13 |
| 3,370,982 | 2/1968 | Hayunga . | |
| 3,688,527 | 9/1972 | Blustain . | |
| 3,766,756 | 10/1973 | Farrar | 68/19.1 |
| 4,447,924 | 5/1984 | Bolton et al. | 68/19.1 |
| 4,842,000 | 6/1989 | Malashenko . | |

FOREIGN PATENT DOCUMENTS

| | | | |
|---|---|---|---|
| 1233428 | 10/1960 | France | 34/639 |
| 2440228 | 5/1980 | France . | |
| 465474 | 4/1927 | Germany . | |
| 668741 | 3/1952 | United Kingdom | 34/639 |
| 895655 | 5/1962 | United Kingdom | 34/639 |
| 909423 | 10/1962 | United Kingdom . | |
| 931653 | 7/1963 | United Kingdom . | |

*Primary Examiner*—Frankie L. Stinson

*Attorney, Agent, or Firm*—Merchant, Gould, Smith, Edell, Welter & Schmidt

[57] ABSTRACT

Systems and methods in accordance with the invention clean particulate matter from photographic film using water without impairment of image bearing portions of the film or retention of substantial water in the film. Water formed into thin sheets is directed at high velocity or with mechanical augmentation against the film in directions at least partially opposite to the direction of film movement. Alternatively or successively, the film passes through water removal stations where dry air is blown onto the film and adjacently drawn off with entrained water in successive alternating flows. The film may be further dried of absorbed moisture in an associated environmental chamber having multiple loops before being wound up on a takeup reel.

12 Claims, 8 Drawing Sheets

FIG. 9
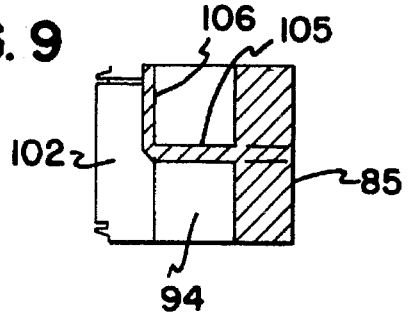
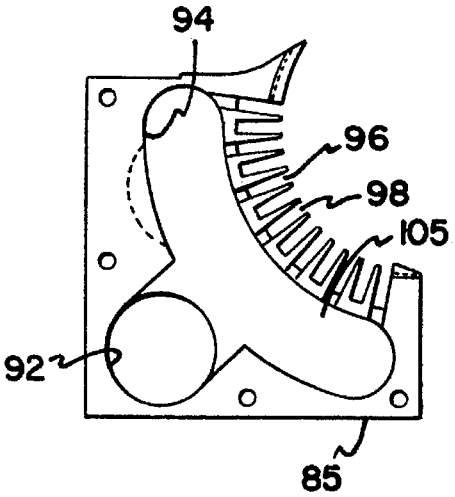
FIG. 7
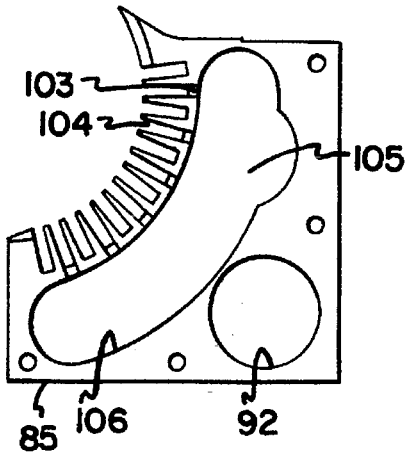
FIG. 8
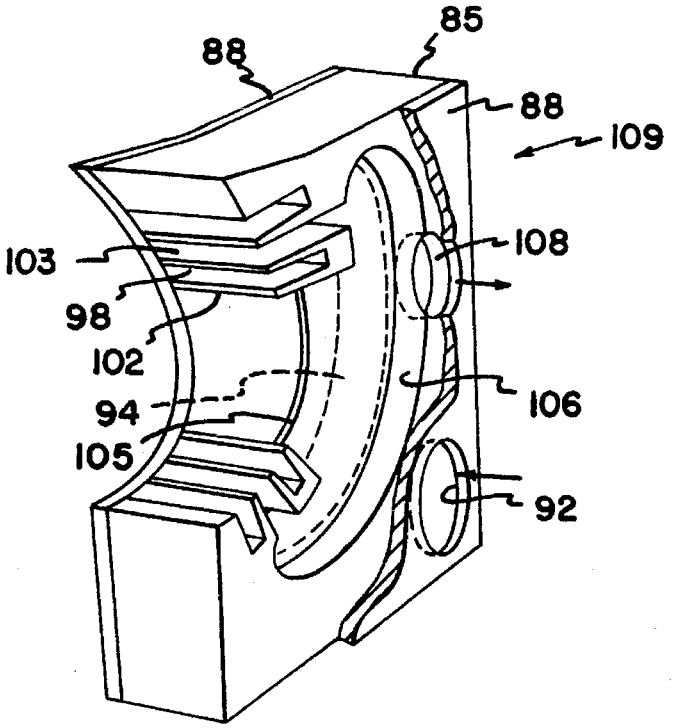
FIG. 6

FILM CLEANING SYSTEM AND METHOD FOR PHOTOGRAPHIC FILM

RELATED APPLICATION

This application is a continuation-in-part of my previously filed application, Ser. No. 08/103,285, filed Sep. 10, 1993, abandoned.

BACKGROUND OF THE INVENTION

This invention relates to apparatus and processes for cleaning photographic film, and more particularly to liquid cleaning systems for long lengths of photographic film, which systems neither significantly affect the image areas of the film nor cause significant detrimental liquid interaction with the film.

In the movie film and photographic industries, over the years, various techniques have been devised for cleaning film surfaces to eliminate dust, particulates and other materials which wear, abrade, or obstruct portions of the photographic image areas. Cleaning is regularly used before printing, but the methods typically used for cleaning have often affected the film itself. For example, one traditional method has been the use of mechanical cleaners, such as the "scrubber cleaner" in which rotary scrubber brushes remove the dirt, while a solvent such as 1-1-1 trichloroethane is employed to carry the dirt away from the film. Some mechanical cleaners can potentially scratch the film while solvents are being discontinued because of their introduction of pollutants into the atmosphere.

In a prior patent, U.S. Pat. No. 4,706,325, I disclose a film cleaner system using rotary brushes which has achieved substantial success in a number of film industry situations. This is a dry brushing system in which soft rotary brushes are disposed in pairs along and on opposite sides of the film path. Each brush of a pair spans a different part of the film width and is angled and rotated in such fashion that dust and other particulates, which tend to be concentrated along the film perforations, are impelled away from the center of the film toward the film edges. The brushes are displaced and angled so that they sweep across the opposite edge perforations and cover both sides of the film. Matter accumulating on each of the brushes is removed by contact with adjacent electrostatic discharge elements which are tube-shaped and slotted to serve additionally as suction devices. This system contacts the image areas of the film and minimizes scratching because soft brushes can be used. However, as stated at col. 5, lines 51–52 therein, "Brush speed is relatively low to avoid centrifugal force dislodging dirt from the brush." The limitations on use of this approach are more precisely viewed in terms of the difficulty of ensuring elimination of dirt particles under the complex forces which act on the particles, including mechanical adhesion, centrifugal force, electrostatic forces and vacuum forces. Taken together, they limit the throughput rate which can be achieved with this approach.

Another common existing method is the use of a cleaning solution, such as 1-1-1 trichloroethane which is excited with an ultrasonic transducer to dislodge dirt particles and transport them away from the film. With this ultrasonic cleaner, the film is easily dried because of the volatility of the trichloroethane. However, the use of solvent solutions is now being severely restricted, inasmuch as they present pollution and potential carcinogenic problems that are no longer acceptable. Using a non-volatile solution, such as water, has heretofore not been acceptable because photographic emulsions absorb water if exposed to water for any length of time. Consequently, the employment of the ultrasonic cleaner approach using water immersion would result in absorption of significant amounts of water that would have to be removed in a drying system called a "dry box." Because the standard in the industry involves cleaning at rates of 50 to 200 feet or more per minute, drying a water-saturated color negative at a speed of 100 feet per minute would entail many minutes of residence time and therefore would require a long path length. This in turn would involve several hundred rollers, large blowers, a heat exchanger, and a massive film transport mechanism, necessitating a dry box of several hundred cubic feet in volume. Moreover, the many rollers used in such a system inevitably introduce dirt into the just-cleaned film. For such reasons, feasible high speed cleaning approaches using water have not previously been devised for photographic film.

SUMMARY OF THE INVENTION

Systems and methods in accordance with the invention utilize substantial sweeping forces acting tangentially with water flows along or across the areas of a moving photographic film, together with immediate non-contact but closely proximate extraction of surface water, succeeded by thermal removal of any absorbed water. The tangentially directed forces for high energy removal of dust, lint and other particulates are provided either by water impelling rotary brushes or by fine sheet jets of water. The brushes are positioned and angled to sweep both sides and both perforated edges of the film, while sheet jets act separately on opposite sides of the film. In either case the film passes through one or more closely adjacent water removal stations in which adhering and adsorbed surface water is extracted by the use of alternating but balanced air flows. To establish reversing air flows, an array of flow conduits define a closely spaced series of nozzles at alternately positive and negative pressure relative to ambient. The nozzles in the water removal stations provide a substantially constant, zero or low net force, without contacting the film except at the side perforations. Thereafter the film is transported into a multiple loop forming dry box system in which temperature and humidity are controlled so as to remove any absorbed water.

In accordance with this system and method, substantial forces are applied along the film surface for displacement of lodged particulates and to clean the entire film. The force vectors are in directions against or partially transverse to that of film movement, so that particulates cannot return to the film surface once dislodged. Using multiple turnarounds in the film path, the arrangement is made compact, the total length of film movement through the system can be short and the exposure of the film to water minimal given the version used.

Both examples of systems in accordance with the invention use two film cleaning stations and two or more water removal stations to clean the film areas on both sides, but the stations are differently arranged in the two examples. In the sheet jet, water only, approach one entire side is cleaned and then water is removed, and the process is repeated for the other side. In the water-facilitated rotary brush approach less than the full film width is cleaned first, but on both sides, and then an overlapping cleaning of both sides to the opposite edge is completed, before the water removal stations are encountered.

In using sheet jets of water alone for cleaning, the film is moved through two convex arcs having opposite directions of curvature. A first side of the film is moved in a first convex arc about a roller supporting only the film edge at the sprocket holes while a high velocity sheet jet of water is directed tangentially to the film at the arc, deflecting slightly off the film and carrying with it particulates adhering to the film. The water flow directly contacts only a short length but full width lateral band of the image area of the film. The energy of the slightly deflected water sheet is absorbed in a closely adjacent downstream chamber under negative pressure, so that return flow effects are minimized.

A feature of this arrangement is that the impacting tangential water sheet is preferably directed parallel to film movement, so that a dry surface is always presented and there is no velocity gradient due to adhering water that would tend to reduce the impact force. At the sheet jet positions, the energy of deflected flows, including mist from film edge perforations, is absorbed in an adjacent energy dissipator that is defined by a converging funnel in communication with a cylindrical chamber at negative pressure.

Immediately after this cleaning action for one side, the slightly wetted film passes in the same arc closely adjacent to a compact series of alternating positive and negative pressure apertures about the roller, forming a water removal station. Substantial volumes of dry air in separate flows serially impact the film to entrain adherent surface moisture, but each dry air flow is closely followed by an opposite flow which removes the humidified air, so that there are successive water removal steps. In addition, only a net force of zero, or a slightly positive force, is applied to the curved and edge supported film because the opposite forces substantially cancel. The water removal station is spaced apart from the cleaning stations for both sides in the rotary brush system, but the water removal stations themselves are essentially the same.

The reverse side of the film is cleaned and water is removed in like fashion but at a convex arc region of opposite curvature sense to the first.

With this arrangement, the edge supported and curved film does not buckle under the forces applied and there is no mechanical contact with the image regions of the film. Thus, there is very effective cleaning action, very short duration but high velocity water impact and virtually immediate extraction of adhering water.

Also, air flows for removing the adhered water may be heated to enhance the drying effect while the water may be cooled to about zero degrees Celsius further to aid in limiting water absorption. In a high speed professional system, one or more additional water removal stations may be employed.

After film cleaning and water removal in each example, the film then passes to a relatively small sized "dry box" in which a desired total length of film can be transported between a series of fixed rollers and a series of movable rollers in a sinuous fashion. When threading, the movable rollers are positioned in close juxtaposition to the fixed rollers, and they thereafter are shifted automatically to the opposite end of the dry box to establish the desired total path length.

The film transport system incorporates a sequence controller, film supply and take up devices, drive means for the film transport, and may include means for controlling film tension during film winding operations. The film cleaning system further includes a closed recirculating system for feeding filtered water to the film cleaning mechanisms (sheet jet or rotary brush devices). The water is filtered down to sub-micron particle size as it is being recirculated. Blowers and temperature controls are employed for the dry box portion of the system, and for the positive and negative pressure portions of the water removal mechanism.

Another feature in accordance with the invention pertains to a unique nozzle for establishing a very thin sheet jet of water of the desired lateral width and linear velocity. This is achieved by arranging a thin, linear deflectable wall edge in parallel and normally contacting relation to a fixed linear wall edge, the two edges forming a boundary at the apex of a converging conduit. The nozzle is normally substantially completely closed by the abutting edges, but when water under high pressure is forced into the converging conduit the deflectable wall edge is slightly displaced. Thus a narrow gap is opened between the parallel edges and a nozzle opening is defined that establishes a film-wide, very thin sheet jet for best film cleaning in accordance with the invention.

In another example of a system and method in accordance with the invention, the forces needed for tangential displacement of particulates from the perforation and image areas are supplied by rotary brushes which are selectively paired and angled, and which receive water flows in the included angle of convergence with the film. The axes of rotation of a first pair are similarly canted at a first angle relative to the width of the film, and offset laterally so as to cover the span from an intermediate region of the film through to the opposite edge. This first pair is rotated so as to direct water and particulates partially sideways relative to the upstream film travel direction. The brushes of the second pair are oppositely canted as well as oppositely offset, relative to the first, and again rotated such that matter thrown off at an angle relative to the upstream direction. Immediately thereafter the film path enters a series of water removal devices with closely spaced conduits of alternating pressure, and surface water is quickly and efficiently removed, before entry into the dry box system.

An aspect of this system is that the water flow into the angle of convergence between a brush and the film is of small width along the brush radii, and directed into the brush tip region. The water stream wets the brush tips, carrying particulates off under centrifugal force, and also providing a lubricating action at the film surface. The brushes can therefore be spun at a high rotational rate and allow the film to be run through the system at throughput rates required by modern systems.

This system operates to clean both sides of negative or positive photographic film at rates in the range of 50 to 200 feet per minute or more, and without contact with the film or the introduction of polluting or harmful solvents.

BRIEF DESCRIPTION OF THE DRAWINGS

A better understanding of the invention may be had by reference to the following description, taken in conjunction with the accompanying drawings, in which:

FIG. 6 is a perspective fragmentary view, partially broken away, of the low net force water removal mechanism used in the arrangement of FIGS. 3 and 4;

FIG. 7 is a side sectional view of the arrangement of FIG. 6 as viewed from the front;

FIG. 8 is a side sectional view of the arrangement of FIG. 6 as viewed from the front;

FIG. 9 is a cross-sectional view of a portion of the arrangement of FIGS. 7 and 8, as viewed from the side;

DETAILED DESCRIPTION OF THE INVENTION

Figure 1:
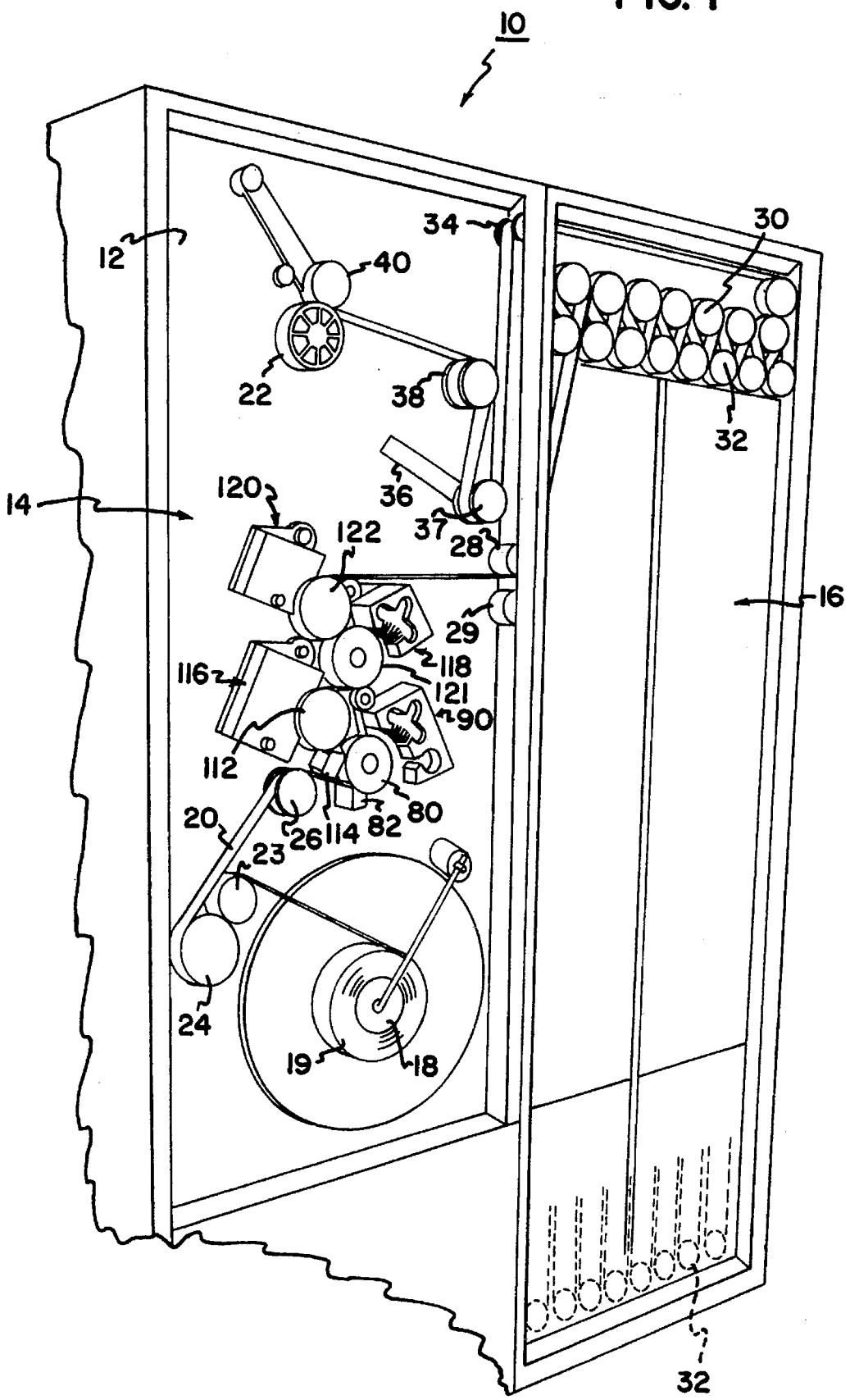
FIG. 1 is a perspective view of the front panel of a film cleaning system in accordance with the invention.
Figure 2:
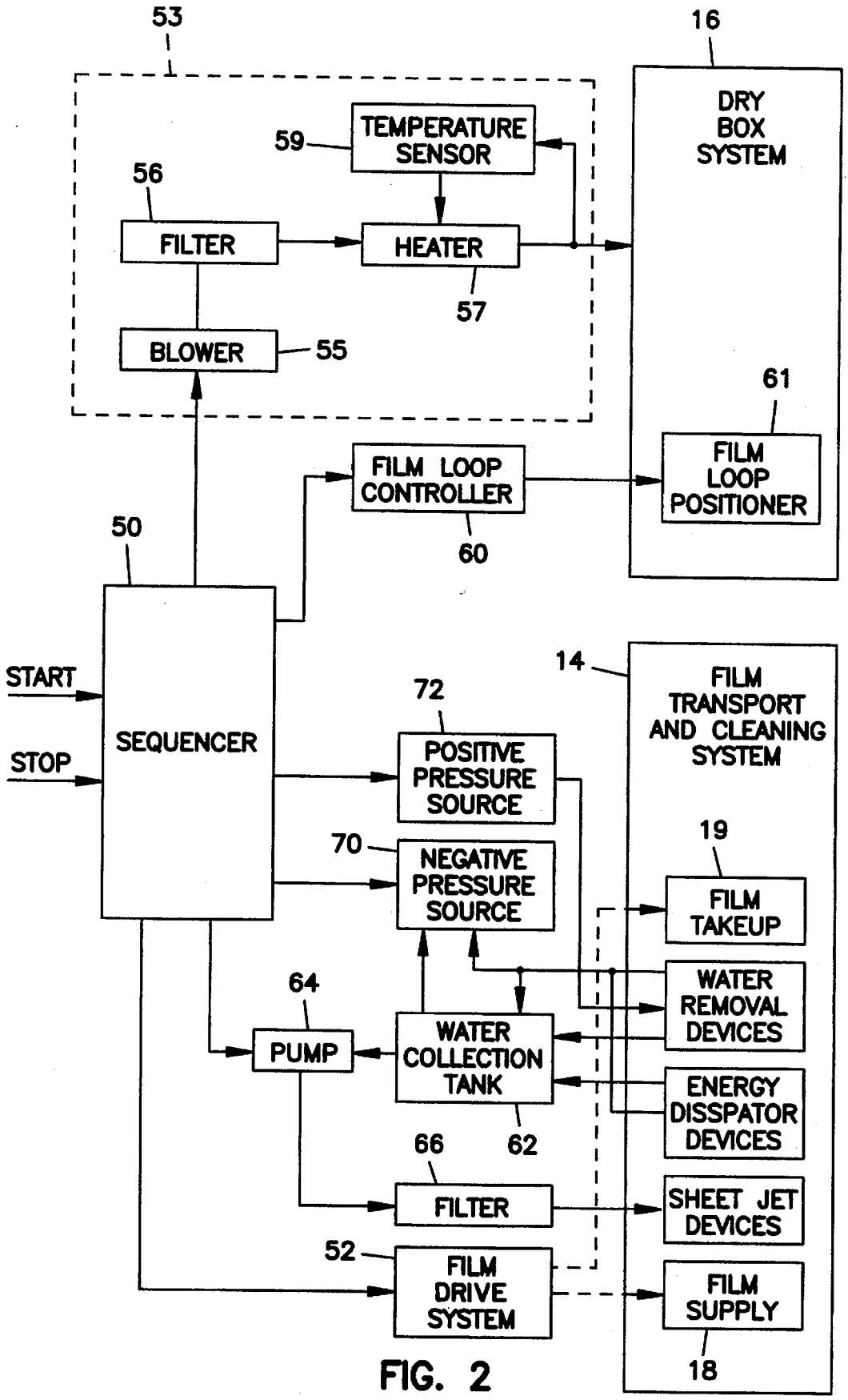
FIG. 2 is a block diagram of the arrangement of the film, water and air handling units employed in the system.

A first example of a film cleaning system in accordance with the invention, referring now to FIGS. 1 and 2, is conveniently mounted with the film handling elements on opposite front halves of a console 10 having a front panel 12. A hinged glass front that seals the interior but provides access for threading is not shown. As viewed in FIG. 1, a water cleaner and dryer subsystem 14 is in the left half, and a dry box 16 is in the right half of the console 10. In this configuration, a supply hub 18 supports a supply reel 19 of film 20 in the lower part of the water cleaner and dryer subsystem 14. The film 20 is fed along a multi-curved path through the water cleaner subsystem into the dry box 16, from which the film 20 is passed out to a take-up reel 22. Because the system operates to drive the film 20 at substantially constant velocity between the reels 19 and 22, and because many conventional systems for this purpose are known, specific braking, tensioning, velocity sensing and like features that may be used will not be shown or described, since they pertain only to the film drive and not the invention being claimed.

In the path from the supply reel 18, the film 20 is guided through a pair of guide rollers 23, 24 and past a guide roller 26 into the water cleaner subsystem 14, internal details of which are described in greater detail below. From the water cleaner and dryer subsystem 14, the film is fed through the sidewall of the dry box 16 between a pair of idler rollers 28, 29 and into a multiple loop system having a set of horizontally aligned fixed guide rollers 30 and another set of horizontal aligned vertically movable guide rollers 32. When the movable guide rollers 32 are adjacent the fixed guide rollers 30, a leader for the film 20 may be threaded sinuously through the rollers 30, 32, as seen in FIG. 1. When the movable guide rollers 32 are driven downwardly during operation, variable loop film lengths are established that increase the total length within the dry box 16, as seen in the dotted line position 321 of FIG. 1. Therefore the residence time for the film 20 as it is driven through the dry box is greatly increased. From the variable length loops, the film 20 is passed by corner rollers 34 back into the water cleaner and dryer subsystem 14 chamber, to a buffer mechanism 36 supporting a roller 37 that controls film length in the take-up region. The film 20 moves around a feed roller 38 to the take-up reel 22, where a guide roller 40 engages the surface of the reel being formed. The takeup rate is kept substantially constant or within limits by conventional means so that cleaning and drying is substantially uniform along the entire length of the film 20.

Behind the front panel 12, as seen in FIG. 1, the console 10 includes subsystems shown in FIG. 2 for controlling mechanical devices, providing the needed differential pressures, and supplying the water flows that are required in the system. Although substantially conventional individually, they function in response to a sequence control 50 to enable entirely automatic operation after initial film 20 threading. Manual sequencing may alternatively be used if desired. A dry air supply system 53 provides air of controlled temperature level to establish a controlled environment within the dry box 16. External air is driven by a blower 55 through a filter 56 and into a heater 57 which is temperature controllable in any one of several known ways using signals from a temperature sensor 59 responsive to the heated air temperature. From the heater 57, the dry air flows through the dry box 16 and then is returned to the surrounding atmosphere. The sequence control 50 also, after starting, provides signals to a film loop controller 60 that operates a film loop positioner 61 for the movable guide rollers 32 in the dry box 16, lowering them after starting and holding them in the full downward position until such time as the end of the film is reached. Distilled water is fed from a supply or water collection tank by a pump 64 through a submicron filter 66 to the water cleaner subsystem 14, outflow being fed back into the system in a recirculating fashion.

The control system also includes a vacuum or negative pressure air source 70 and a positive pressure source 72, these supplying needed functions in the water cleaner subsystem 14.

Figure 3:
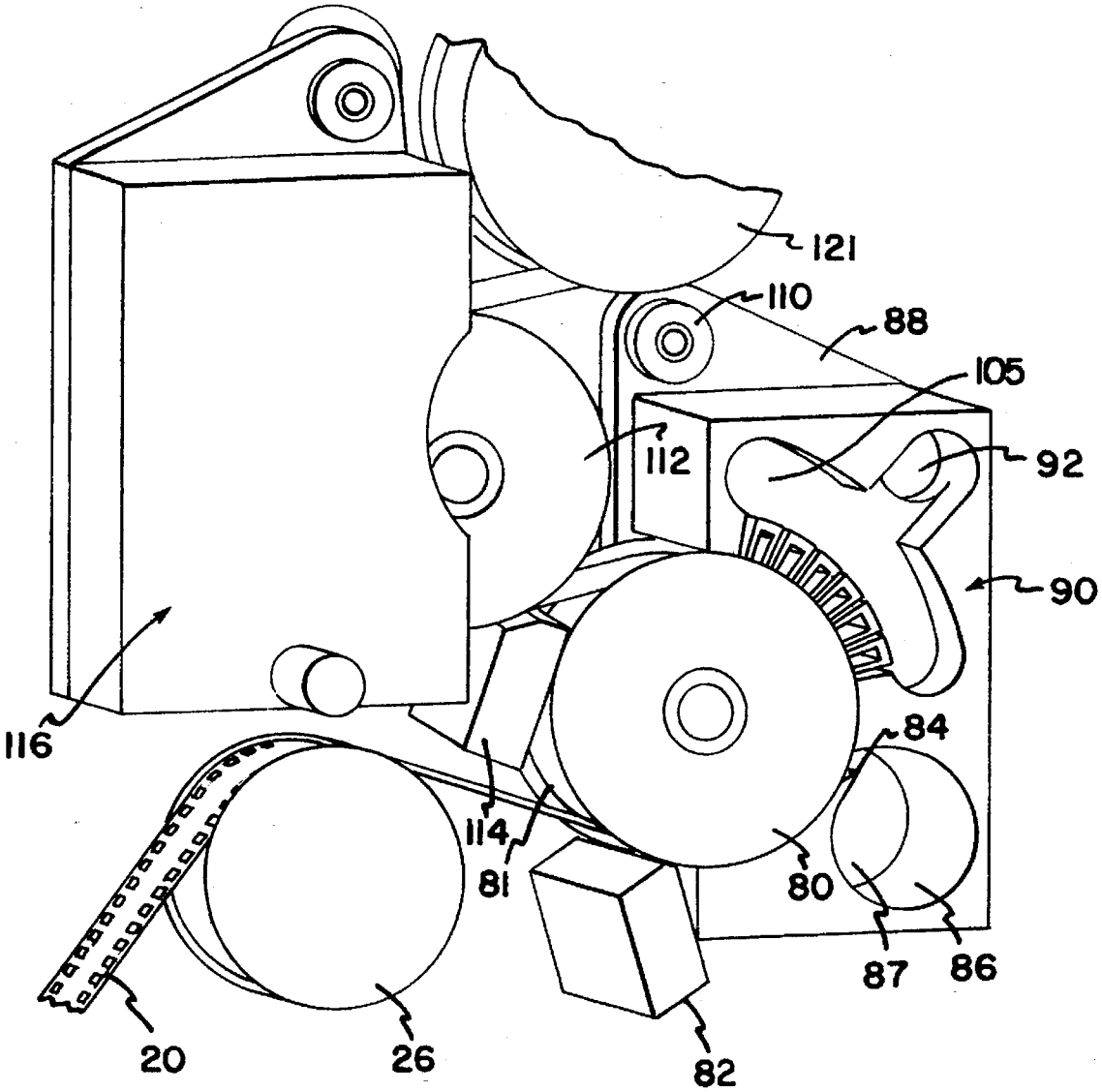
FIG. 3 is an enlarged perspective view of a portion of the mechanisms on the front panel of FIG. 1, showing the principal elements of the film cleaning system.
Figure 4:
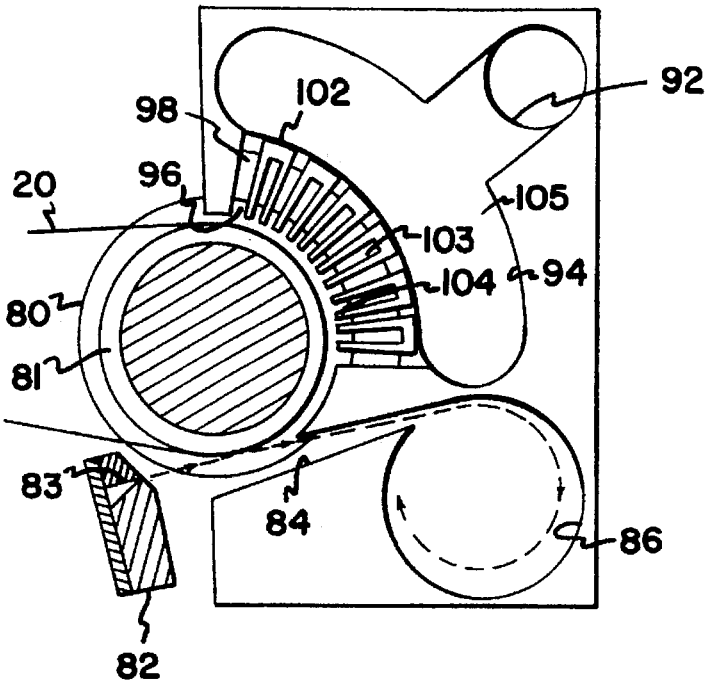
FIG. 4 is a side sectional view of a portion of the system of FIG. 3, and showing a portion of the mechanism for cleaning and removing water from opposite sides of the film.
Figure 5:
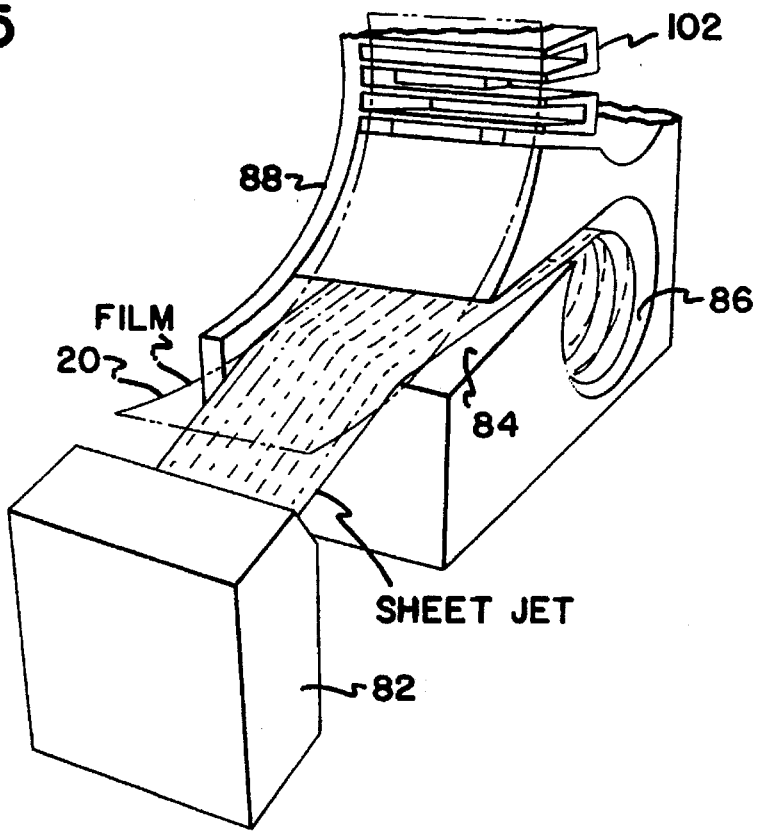
FIG. 5 is a perspective view, partially broken away, of the sheet jet water cleaning and energy dissipating portion of the mechanism of FIG. 4.
Figure 12:
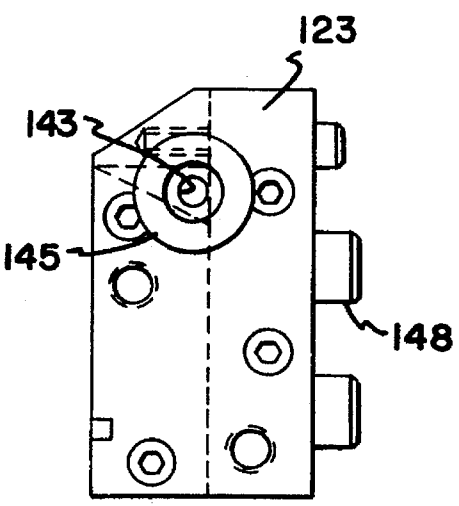
FIG. 12 is a side view of the device of FIGS. 10 and 11, viewing the device from the water inflow side.
Figure 10:
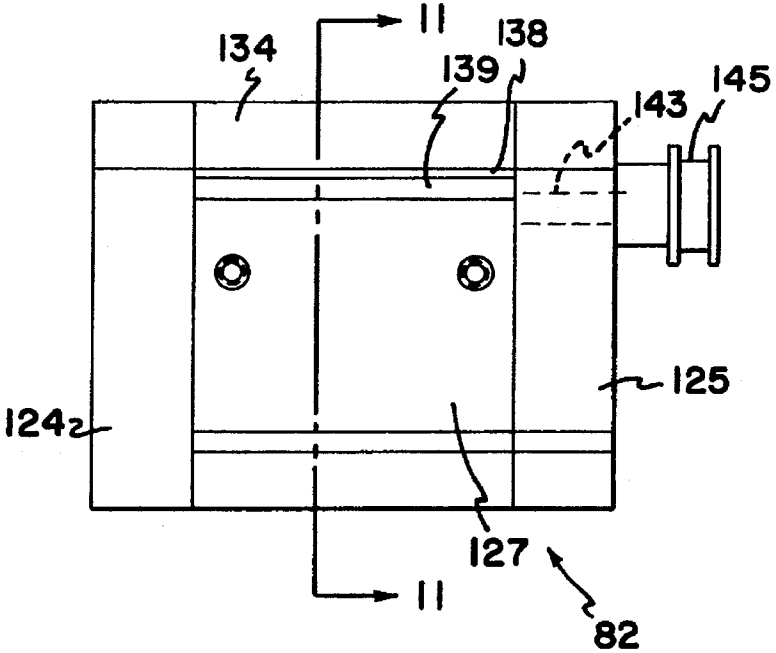
FIG. 10 is an end view of a sheet jet device in accordance with the invention.
Figure 11:
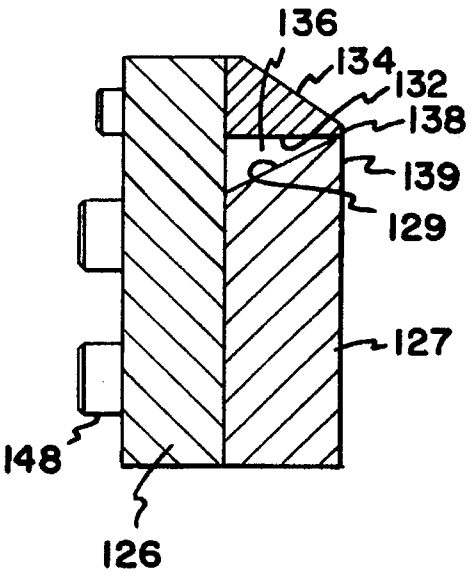
FIG. 11 is a side sectional view of the device of FIG. 10, taken along the line 11—11 in FIG. 10 and looking n the direction of the appended arrows.

The water cleaning and water surface removal subsystem 14 is a compact arrangement utilizing a pair of closely spaced rollers each of which provides a greater than 180 degree wraparound arc of the film 20. As seen in FIGS. 3 and 4, the roller 80 for a first wraparound arc provides counterclockwise passage of the film 20 about the center of the roller. The roller 80, as well as all other rollers in the system, has raised side ridges 81 and a space between the center of the roller and the image portion of the film, as best seen in FIGS. 3 and 4. Adjacent the film 20 as it enters this first wraparound arc is a first sheet jet device 82 receiving pressurized water from the system via a conduit, and having a nozzle 83 (FIG. 4) directing a flow tangential to the curvature of the arc, and in the same direction as movement of the film 20. A specific example of a preferred nozzle is shown in FIGS. 10–12 and described hereafter. As seen in FIGS. 4 and 5, a narrow band of water (approximately the width of the film 20) in a thin sheet impacts a very small lengthwise span of the film at a high velocity and low angle. The velocity is substantially greater (typically orders of magnitude) than the velocity of the film 20 along its path. The water deflects slightly toward and into the mouth of a converging funnel 84 formed within a shaped downstream water collection block 85. A cylindrical energy dissipator chamber 86 is positioned on the opposite side of the impact region from the first sheet device 82, and has its periphery tangential to the flow coming in from the funnel 84. At the rear side, the chamber 86 leads to a water outlet conduit 87 (FIG. 3 only) concentric with the axis of the chamber. The collection block 85 is flush against the front panel 12, and a sliding seal is established for flow through the conduit 87 to the water recirculation system and to the source of negative air pressure 70 (FIG. 2 only) in the system. Thus, not only is the great majority of the water mass confined within the funnel 84 and the chamber 86, but a negative air pressure exists in the vicinity of the film 20. Consequently, a thin mist of overspray which rises from impact of the water, principally that against the perforations on the sides of the film 20, is also drawn off, and the amount of surface adhering water is greatly reduced.

A first water removal unit 90 in accordance with the invention and use in both examples described herein is also disposed along the path of the film 20. The water removal unit 90, in this example, occupies most of the remaining portion of the wrap-around arc at the first roller 80. The unit 90 is advantageously formed in this instance as part of single block 85 with side housing plates 88 (one of which is omitted for better viewing in FIGS. 1, 3, 4, 5 and 6) and has a double-sided configuration as evident in FIGS. 7 and 8. Referring to those Figures as well, a positive pressure inlet 92 leads into a positive pressure manifold 94 that is conveniently disposed substantially concentric about the central axis of the roller 80. Short segment radial conduits 98 terminating in nozzles 96 adjacent the film 20 are spaced apart along the water removal arc. These conduits 98 and nozzles 96 therefore provide small band-like jets of positive pressure flow onto the film 20 surface. The side walls of the positive pressure conduits 98 are defined by the outer walls of U-shaped members 102 whose interior walls establish negative pressure conduits 103 alternating with the positive pressure conduits 98 and terminating in a negative pressure nozzle 104. The terms "positive" and "negative" in this context refer to local pressures relative to the ambient pressure in the system. A separator wall 105 orthogonal to the conduits 98, 103 divides the positive pressure manifold 94 from a substantially coextensive negative pressure manifold 106 (FIG. 8). The negative pressure conduits 103 communicate in the first water removal unit 85 with the negative pressure manifold 106 (FIGS. 8 and 9 particularly) leading to a negative pressure outlet 108 (FIG. 6) from the block 85. Thus the entire water removal unit 90, including the energy dissipator chamber 86 and the two conduit systems are conveniently incorporated within the single housing 109 (FIG. 6). Referring again to FIG. 1, the housing 109 is attached to the front panel 112 on a pivot 110 and is movable through a limited arc about the pivot to open a space for threading the film leader about the roller 80. Sliding seals (not shown in detail) between the openings in the housing 109 couple the inlet and outlet 92, 108, respectively, that are seen in FIG. 6, to external sources 72, 70 respectively (FIG. 2) to permit this pivoting action.

The flows toward and away from the film 20 surface can be precisely adjusted by controlling the flow rates or the nozzle areas, or both. Preferably the total force of the positive pressure flows is slightly greater than the total of the negative pressure flows so that even though the film does not buckle it is held against the adjacent roller in the event of a breakage. Also, the flow pressure of dry air onto the film is preferably slightly greater than the outflow pressure of air at the next adjacent nozzle, because in sweeping across the film the air cools off and gains in humidity, and therefore is slightly more dense. Nonetheless, because opposite forces on small areas alternate, the film can be supported only along its edges the forces can be said to be substantially balanced. Although a slight positive force is generally preferred it will be appreciated that zero net force can also be employed.

Immediately after leaving the first roller 80, the film 20 is transported around a second roller 112 providing a wrap-around arc in the opposite (i.e. counter-clockwise) direction. This water cleaning station is depicted only in general form, inasmuch as the second sheet jet device 114 and second water removal unit 116 may be identical to that previously described, except for the relative positions with respect to the second roller 112. In passing from the first roller 80 to the second roller 112, the film 20 is in effect inverted and consequently both sides are cleaned and dried. Thereafter, in the film path, successive third and fourth water removal units 118, 120 are used, with the film passing in 180 degree arcs around the third roller 121 in the counter-clockwise direction and a fourth roller 122 in the clockwise direction. From the fourth roller 122, in the example of FIGS. 1 and 2, the film is fed between the idlers 28 and 29 into the dry box 16, wherein the multiple film loops are formed between the fixed and movable rollers 30, 32. The film 20 is returned from the dry box 16 into the left side of the front panel 12, via the corner rollers 34 and the buffer arm roller 37 to the take-up reel 22. In some circumstances, there may be adequate drying in the water cleaning and drying system 14 so that a dry box may not be needed.

In the operation of the system of FIGS. 1 and 2, taken in conjunction with FIGS. 3 and 7, after placing the full supply reel 19 in position on the supply hub 18, the operator pivots the housings containing the various water removal devices 90, 116 and the third and fourth water removal units 118, 120 away from their associated rollers to provide easier threading of the film leader about the rollers 80, 112, 121, 122. Having threaded the film 20, through the water cleaner and drying subsystem 14, or before, the operator sets the sequence control 50 to a start mode, causing the movable set of rollers 32 to move upwardly, to a position adjacent the set of fixed guide rollers 30. Then the leader for the film 20 may be threaded throughout the remainder of the film path, through the roller sets 30, 32 in the dry box 16, and back through the buffer arm roller 37 and feed roller 38 onto the take-up reel 22.

Concurrently, the elements of the associated system of FIG. 2 are brought into a normal mode of operation, with air flowing from the dry air supply system 53, and with the dry air supply system 53 bringing the temperature in the dry box 16 into equilibrium at a desired level. The film drive system 52 maintains the transport rate of the film 20 through the system substantially constant, at a rate of about 200 feet per minute in this example. Water flow is supplied at suitably high pressure to each of the sheet jet devices 82, 114 from the pump 64 and filter 66, and the vacuum or negative pressure source 70 is activated to provide suction in the water removal units 90, 116, 118 and 120.

Air flow through the dry box 16 is from the heater 57 via the blower 55 and filter 56 and out to the atmosphere. Recirculation and dehumidification are not used although either one or both can be employed. Positive pressure is also provided to the water removal units 90, 116, 118, and 120, as water is recirculated by the pump 64, from the water supply 62, through the filter 66, through the active devices on the front panel 12 and back to the water supply 62 via the pump 66. As film transport is commenced by the sequence control 50, the film drive system 52 having been activated, the movable guide rollers 32 are moved downwardly by the position control 60 until multiple film loops are formed to provide, in this example, in excess of 100 feet of film loop in the dry box 16. The extended film loops are shown in dotted line position of the bottom of the dry box 16 in FIG. 1.

It will be appreciated that where a shorter total path length is suitable in the dry box 16, the fixed rollers 30 can be spaced apart by a distance great enough to allow the movable rollers 32 to be raised between them to a higher level. Consequently, film threading in the dry box 16 can involve only a straight-through horizontal path. It will also be appreciated that in some situations the absorbed water in the film 20 may be low enough so that no dry box is needed.

Referring now to FIGS. 3 to 8, it should be understood that the sheet jet device 82 therein depicted provides a very effective cleaning action without mechanical contact. With the film 20 moving in the same direction as the sheet jet, the water sheet extends in a band laterally across the film 20, and directly impacts only a short length of the film 20 at any instant (here only of the order of 3 mm). Contact is thus made only with a dry and curved surface and at a low angle. Consequently, the sheet jet is deflected off at a low closely confined angle, within the cross-sectional area of the entrance of the converging funnel 84. Where the sides of the sheet jet strike in the vicinity of the perforations on the film 20, a light mist is created adjacent the funnel 84. Most of the water mist is removed, however, under the negative pressure that exists in the funnel 84 due to the vacuum drawn on the energy dissipator chamber 86. As the sheet jet enters the chamber 86 tangentially it circulates within the cylindrical chamber 86, while moving axially toward the outlet conduit 87. This dissipates the considerable energy without allowing any return to the vicinity of the film 20. The substantial majority of the remaining water adhering to the film 20 is thereafter eliminated in the water removal unit 90. In that unit the positive and negative pressure nozzles 96, 104 adjacent the film 20 at the end of the short radial conduits expose the film to compact, high velocity alternate impinging and withdrawing air flows. The dimensions of the nozzles 96, 104 along the length of the film 20 are less than one-quarter inch (0.65 cm). In this example seven positive pressure nozzles 96 are separated by six negative pressure nozzles 104. Consequently, there is a serial progression of water removal actions, with dry air impinging the film and immediately being drawn off, carrying humidified air with it from water on the film.

Although the roller 80 provides mechanical support only for the film 20 edges in the region of the perforations, as seen in FIG. 4, these pressures on small areas of the film exert opposite relatively high forces that are below the force level at which the curved film will buckle in both inward and outward directions. A force in one direction is very quickly cancelled, or almost cancelled by a force in the opposite direction. Thus, there is neither bending inwardly to contact the image area against the roller nor outwardly to contact the ends of the radial conduits 94, 106.

Since there is substantially zero net bending force on the film 20 in this region, the film does not contact adjacent surfaces, even though substantial flows may be employed. Because hot air flows of considerable velocity act in a progressive manner, there are successive decreases in the adhering water level as the film 20 is transported through the water removal arc. As each positive pressure nozzle is passed, water vapor is entrained in the air flow and removed in the opposite direction, away from the film 20, before another dry flow impinges. Very little water remains as the film 20 passes to the second water cleaning device 114, 116. At this device, the other side is water cleaned and water is removed in similar fashion. For higher performance operation, the present system includes the third and fourth water removal units 118, 120 to enable operation at a higher throughput rate prior to the dry box 16.

In the dry box 16, the film loops that are defined when the movable rollers are at their lowermost positions are selected to provide a total path length chosen with respect to the desired machine speed. In a practical example, an 80 foot total path length provides a one-half to one-minute residence time, which, at a temperature of approximately 110° F. and a humidity of 20% is adequate to remove any moisture absorbed in the film and to clean and dry a full length positive or negative film is less than 20 minutes. Again, the rollers are of the type previously described that edge support the film only in the perforation region. The film passes out to the take-up reel 22 via the buffer arm roller 37 with the buffer arm 36 compensating for minor variations and maintaining constant path length. By increasing the path length in the dry box the machine speed can be correspondingly increased.

In general terms, the thinner the water sheet jets are the more efficient the system will be in the use of water and the less water energy will have to be dissipated. The nozzle device of FIGS. 10–12 is advantageous for this purpose and is preferred. The sheet jet device, for example the first sheet jet device 82, is assembled by securing side walls 124, 125 to a back block 126. A front block 127 is disposed between the side walls 124, 125 at the lower side (as seen in FIGS. 10–12). The top wall of the front block 127 is a planar surface 129 that is angled upwardly, from rear to front, to form one side of a converging nozzle. The superior wall of the converging nozzle is the underside 132 of a top block 134, attached to the back block 126, and level or horizontal in these views although the orientation will be understood to be arbitrary. Thus an interior chamber 136 is defined within the sheet jet device 82, leading in the direction of convergence to normally contacting edges 138, 139 of the top block 134 and front block 127, respectively. A conduit 143 in one side wall 125 provides a flow path between an inlet port 145 and the chamber 136. Bolts 148 secure the different parts of the first sheet jet device 82 with the needed strength to withstand the internal pressure applied.

With this arrangement, when high pressure (e.g. approximately 500 psi) water is coupled into the chamber 136 via the inlet port 145, the forces exerted on the edges cause a spreading deflection, such that a very small gap or nozzle mouth is formed across the lateral width of the front block 127, approximately equal to the width of the film 20. The angle of convergence and the material employed (typically steel) are selected such that the desired gap dimensions exist for the chosen pressure, creating a sheet jet of less than the order of one millimeter thick, at a velocity that is orders of magnitude greater than the linear film velocity. The device, despite these capabilities, requires no complex machining operation or complex parts.

Radially directed nozzles alternating along the circumference of the wraparound arc are preferred because of their serial action on the film. However, other configurations may be used in accordance with the principles of maintaining substantially low net force within a total area divided into small areas of positive and negative pressure. The dividers between positive and negative pressure nozzles may, for example, be aligned with the direction of film movement.

Figure 13:
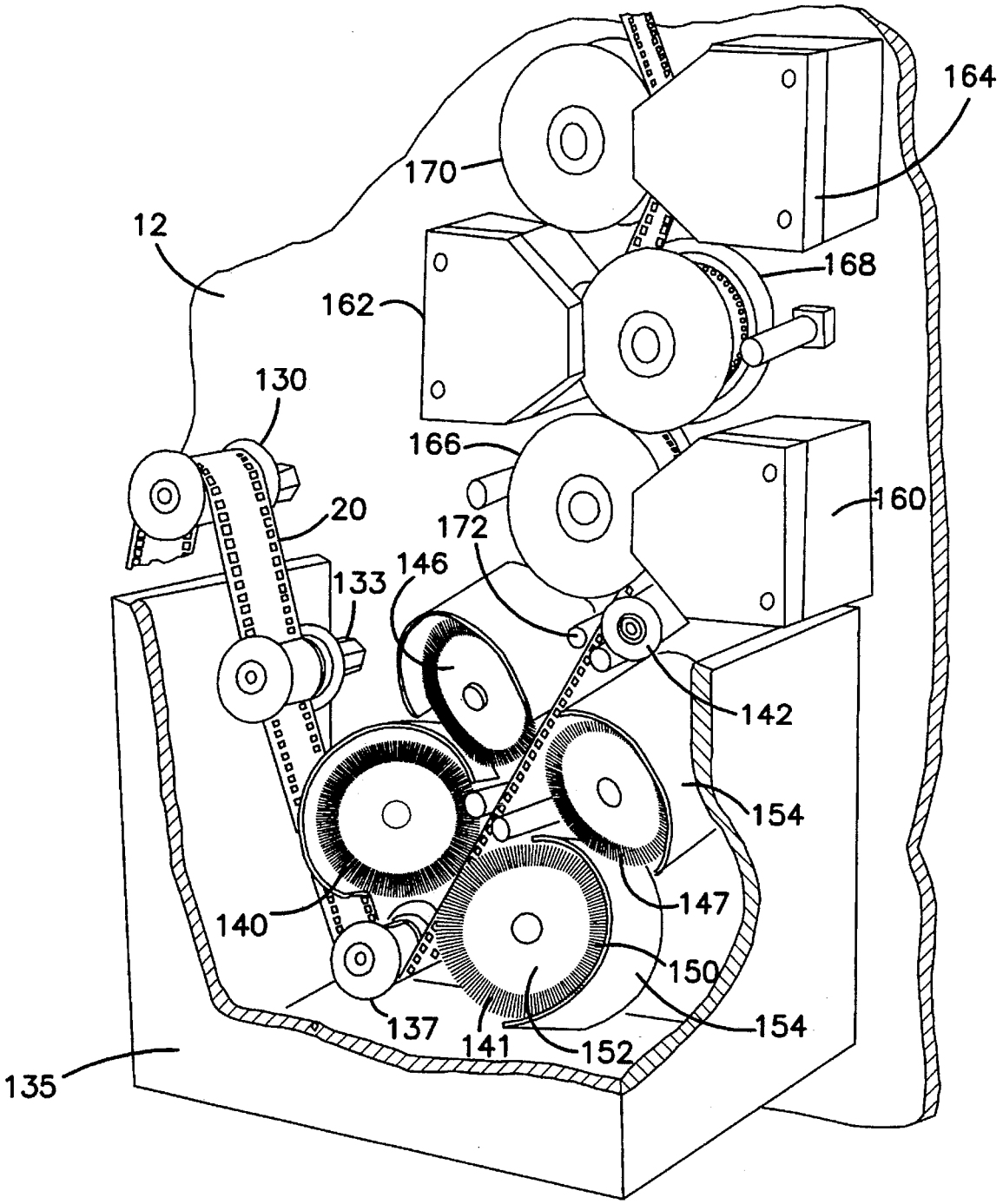
FIG. 13 is a perspective view of the arrangement of an alternative form of film cleaner in accordance with the invention using rotary brushes.
Figure 15:
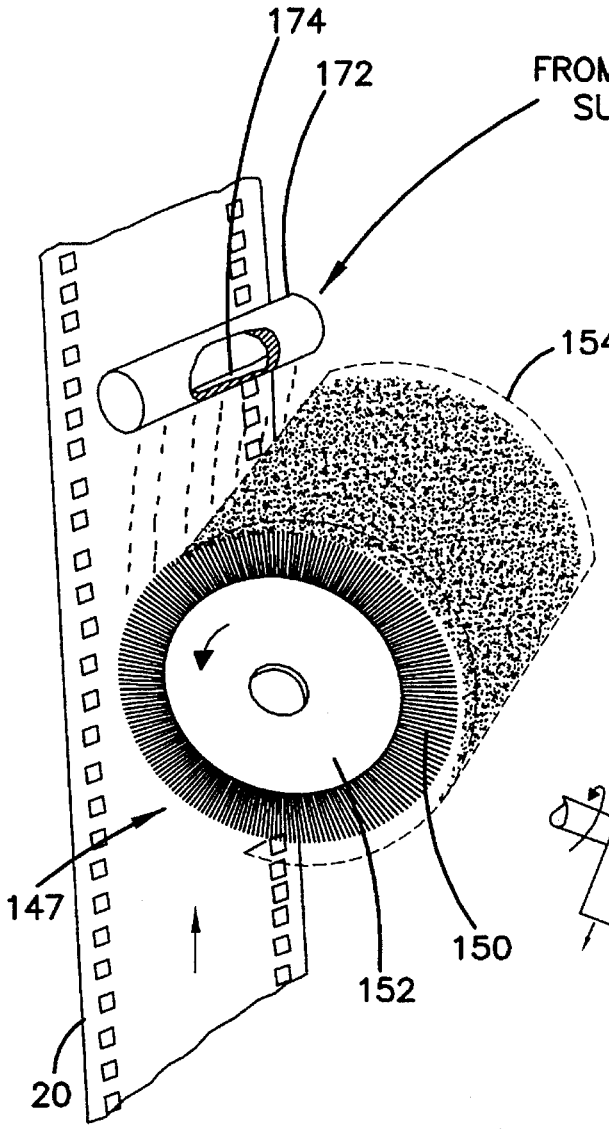
FIG. 15 is a side view of the arrangement of a water feed nozzle to the adjacent rotary brush and film in the arrangement of FIGS. 13 and 14.
Figure 14:
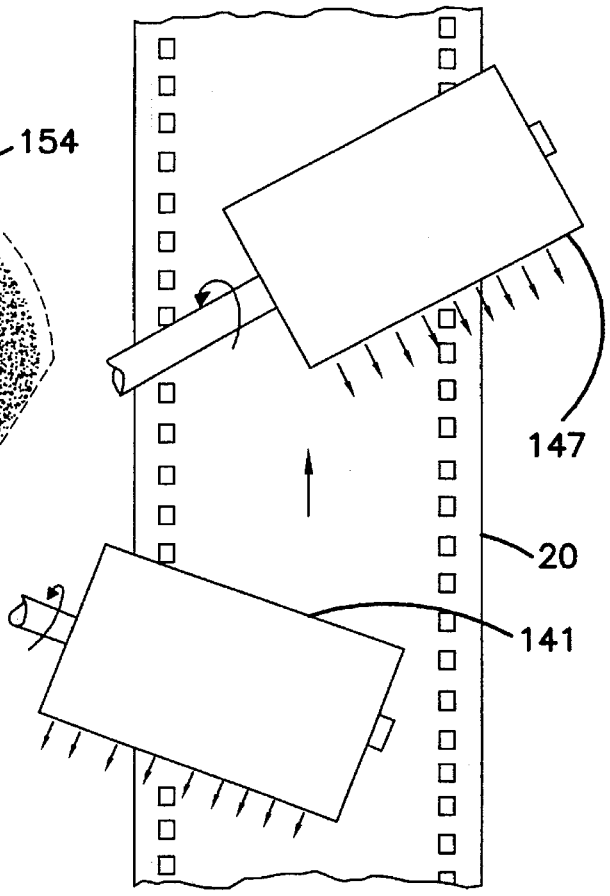
FIG. 14 is a schematic view of a portion of the arrangement of FIG. 13, showing the disposition of the rotary brushes relative to the film.

The film cleaning system of FIGS. 13 to 15, to which reference is now made, uses water-facilitated rotary brushes preceding water removal stations. This system functions with a film supply, dry box and film takeup, together with associated controls, as described above in conjunction with FIGS. 1 to 12, so that description of the arrangement and operation of these units accordingly will be omitted. As in the prior example, film 20 is fed from the supply reel (not shown) across rollers 130, 133 into a film cleaner, here comprising elements within an open-topped water collector 135 on the front panel 12 of the system. The water collector 135 feeds water into conduits (not shown) for recirculation as previously described. Adjacent the bottom of the interior of the collector 135 the film 20 is wrapped about a roller 137 and turned to an upward angle to follow a substantially linear path to an interior roller 142 at the upper end of the cleaning station. Along this short path are disposed a first pair of rotary brushes 140, 141, and a spaced apart second pair of rotary brushes 146, 147. The brushes 140, 141, 146, 147 are driven at a constant speed by any of a number of conventional means, such as separate motors, linkages to a common motor, or a drive of the type shown in my U.S. Pat. No. 4,706,325. Preferably the rotational rate is in the range of 500 rpm, and in any case is typically above 200 rpm.

The brushes 140, 141 of the first pair are rotated about parallel axes on opposite sides of the film 20, the angle of these axes being canted relative to the width of the film 20, and offset relative to the longitudinal center of the film 20. The rollers 140, 141 are sized and angled to span from a midregion of the film 20 across a substantial part of the film image area and completely cover and sweep the perforations in the film 20 on the opposite side, as shown in FIG. 14. The brushes 144, 145 of the second pair are oppositely canted and offset relative to the film 20, with respect to the first pair. Thus, the image areas are swept twice in their central regions. Because the brushes rotate in directions such that their peripheries contacting the film 20 move partially in the upstream direction relative to film motion (see FIG. 14) as well as partially transversely, the particulate matter on the film and in the perforation area is swept off to the side.

The brushes 140, 141, 144 and 147 are here shown as constructed with brush elements 150 extending radially from a central hub 152 (FIG. 13), but other arrangements will suggest themselves to those skilled in the art. The material of the brush fibers is chosen to have a suitable combination of diameter, rigidity and surface hardness to perform the sweeping function, for which many synthetic and animal fibers are available. Splash guards 154 are placed about and concentric with a portion of the circumference of each of the brushes 140, 141, 146, 147. The splash guards 154 are closely adjacent to the brush peripheries but terminates short of the film 20, forming substantial but not complete circular barriers. The functions of the splash guards include preventing the contamination of adjacent brushes with particulate matter and limiting outward dispersion of droplets and mist within the water collector 135. Where particulates and water are thrown off the film by the brushes, they will not collect either on the same brushes or any others.

After passing through the cleaning station defined by the brushes 140, 141, 144, 145, the film 20 moves upwardly from the open end of the water collector 135, to a series of water removal units 160, 162, 164 of the types previously described in detail with respect to FIGS. 1–12. With respect to the first water removal unit 160, for example, the film 20 is turned in an arc around a roller 166 immediately adjacent the nozzles (not shown) in the unit 160, and water adhering to the film 20 on one side is extracted. This is repeated on the other side of the film 20 as it is turned around a second roller 168 associated with the second water removal unit 162, and then a final pass is made through the third water removal unit 164 and third roller 170 combination. After the three removal steps, the film 20 is substantially free of accumulated surface water and adsorbed water and passes to the dry box (not shown) and takeup reel (not shown).

The cleaning action at the brushes 140, 141, 146, 147 is affected in coaction with a unique water injection system that provides a controlled flow into the contact region between the brushes and film 20. As seen as FIGS. 13 and 15, cylindrical nozzles 172 are mounted transverse to the film 20 in each of the convergence zones defined between a rotary brush, e.g. brush 147 in FIG. 15, and the film 20. The nozzles 172 include longitudinal slots 174 which emit a thin transverse sheet of water toward the point of tangency between the brush tips and the film 20. The water sheet in one practical example is only about 1/32" thick, and the flow accordingly directly wets only the terminal portions of the brush fibers. The water lubricates the contact area, reducing the friction between the brushes and film and the tendency to scratch or abrade the film 20. More significantly the water also entrains any particulates that are on the perforation regions of the film, where most particulates tend to accumulate, as well as on the image areas of the film. Also, particulates entrapped among or adhering to the fibers of the brushes are freed due to a combination of factors. Since the water is conductive to electricity, static charges do not develop from the frictional engagement between brushes and film and there is no electrostatic attraction. Centrifugal force exerted on any matter adhering to the fibers causes this matter to be thrown off with the water. Because the tips of the fibers collect the particulates, and the water wets the tips primarily, the effect of centrifugal force in dispersing dirt and particles is best utilized. Most of the water and particulates are thrown off at the separation region between brush tips and the film, downwardly toward the floor of the collector 135. Other water and particulates may be impelled toward the adjacent splash guard 154, particularly in the initial arc, and this matter also gravitates to the floor of the collector 135.

The forces acting vectorially in the angled outward and upstream direction in the plane of the film at the region of brush tip contact are thus augmented by the centrifugal forces on matter in the fibers and the entrainment of matter with water. Particulates, when collected are held at the brush tips until forced off and do not become embedded in the brushes. Further, there is a static free environment to prevent adherence so that the centrifugal force is fully effective. Combination of these factors with the geometry of the brush system, which insures that lint, dust and other particulates at the perforations, where most such matter accumulates, is separated out in a definitive manner, provides high speed and superior performance. Since centrifugal force is used in aid of the separation, the brushes can be rotated at any rotational rate desired for high performance.

In both examples in accordance with the invention a sweeping action at an angle at or close to the plane of the film is used in a direction at least substantially opposite the direction of film movement. Water is a key factor in the effectiveness of both systems, whether functioning solely as a thin sheet of high velocity flow, or used with mechanical brushes to provide a new mode of operation. The use of water is further made feasible in a compact structure because of the virtually immediate removal of surface and adsorbed water by closely positional pressure balanced water extraction nozzles which function without contact with the film image areas. Although three water removal units have been used in practical systems for a higher level of assurance, some applications will permit the use of only two such units, while there is no limitation on using more than three if desired. The system is made particularly compact and of short path length by the arrangement of turnaround rollers that provide selected large and small wrap angles within the overall system.

Although a number of forms and modifications in accordance with the invention have been described, the invention is not limited thereto but includes all variations and alternative expedients within the scope of the appended claim.

I claim:

1. A system for cleaning film at high rates of speed comprising:

a film transport system including means for supplying and collecting film;

means disposed along the path of the film for directing sheet water flows substantially along the plane of the film in directions substantially downstream relative to the direction of film travel; and water removal means disposed along the path of the film subsequent and adjacent to the means for directing sheet water flows for extracting surface and adsorbed water from the film, said water removal means comprising at least one series of closely spaced air nozzles adjacent the film, the nozzles extending across substantially the width of the film and being narrow in the direction of film travel, to establish adjacent and alternate negative and positive pressure air flows at the film surface, to minimize adsorption of water by the film.

2. A system as set forth in claim 1 above, wherein the water removal means comprises at least two series of air nozzles, each disposed adjacent a different side of the film and each series providing a low net force on the film.

3. A system for cleaning film at high rates of speed comprising:

a film transport system including means for supplying and collecting film;

means disposed along the path of the film for directing thin sheet water flows substantially spanning the film width and substantially along the plane of the film in directions substantially downstream relative to the direction of film travel;

water removal means disposed along the path of the film subsequent and adjacent to the means for directing sheet water flows for extracting surface and adsorbed water from the film, said water removal means comprising at least two series of closely spaced air nozzles, each disposed adjacent a different side of the film, the nozzles providing alternate negative and positive pressure air flows, and each series providing a low net force on the film;

and wherein the system further includes film guide rollers closely spaced adjacent each series of air nozzles, the rollers supporting the film along only the edges thereof, and wherein the different series of air nozzles are each disposed along a circumferential arc relative to the adjacent roller, and dry box means disposed along the film path between the water removal means and the means for collecting film for extracting water absorbed by the film.

4. A system as set forth in claim 3 above, wherein the means for directing sheet water flows comprises means for directing high velocity sheet jets at a low angle relative to an impact area on the film, and water collection means adjacent the impact region for receiving water and matter from the film, and wherein sheet jet water flows are directed separately against opposite sides of the film and the system includes water removal means after each of the means for directing high velocity sheet jets onto the film.

5. A system as set forth in claim 3 above, wherein the means for directing sheet water flows comprises at least two pairs of rotary brushes, the brushes of each pair rotating about a central axis canted relative to the width of the film and offset relative to the longitudinal center of the film, wherein the central axes of the brushes of the two pairs are oppositely canted and the pairs of rotary brushes are oppositely offset relative to the film.

6. A system as set forth in claim 5 above, wherein the two pairs of brushes are adjacently disposed along the path of film travel and each pair spans and contacts a portion of the film width from an intermediate region to and across a different edge, and wherein the system further includes at least a pair of water removal means disposed along the path of film travel after the means for directing sheet water flows, each associated with a different side of the film.

7. A system as set forth in claim 3 above, including further a number of film guide rollers disposed along the film path adjacent the means for directing sheet water flows and the water removal means for defining a convoluted film path of short total length across said means.

8. A device for water cleaning of the surface of a photographic film without substantial wetting comprising:

means for transporting the film along a curved path for a selected distance;

means disposed along the curved path for directing a thin sheet jet of water of a width substantially coextensive with the film width tangential to the film and downstream in the curved path region to impact and deflect from a short lengthwise span of the film; and means including a converging channel disposed downstream along the film path, and along the path of the water deflected from the film, for dissipating the energy of the water in the film.

9. A device as set forth in claim 8 above, wherein the means for directing a sheet jet comprises means defining a water chamber converging at linear edges normally in contact, and means including water pressure means coupled to the chamber for deflecting at least one of the edges to establish a narrow, wide flow gap space therebetween.

10. A device as set forth in claim 9 above, wherein the means for dissipating the energy comprises means defining a substantially rectangular cross-section converging funnel extending approximately the width of the film and having an inlet aperture in the path of the deflected sheet, the funnel converging in the direction of the path of water deflected from the film;

means defining a cylindrical chamber having a central axis parallel to the transverse direction of the film and the funnel, the cylindrical chamber communicating with the narrow end of the funnel along a direction tangential to the periphery of the chamber; and means for creating a negative pressure in the chamber to draw off the water in the chamber and flowing within the funnel.

11. A device for providing a thin sheet jet of flow along a predetermined width comprising:

means providing a high pressure water flow;

means defining a water chamber coupled to receive the water flow, said means comprising a pair of adjacent elements having facing walls converging to contacting linear wall edges extending substantially along the distance desired for the width of the sheet, the walls and edges being configured such that at least one of the edges deflects away from the contacting position relative to the other under the water pressure to define a linear nozzle gap between the edges providing the desired thickness of sheet jet at high velocity.

12. A device as set forth in claim 11 above, wherein the device includes a back element, a top element attached to the back element, a front element attached to the back element, the back element having a front wall which together with the facing walls of the top and front elements defines the water chamber, and side walls attached to the other elements for closing off the sides of the water chamber, one of the side walls including a water inlet conduit communicating with the water chamber.

* * * * *